US005819961A

United States Patent [19]

Harris

[11] Patent Number: 5,819,961

[45] Date of Patent: Oct. 13, 1998

[54] PORTABLE VALET

[75] Inventor: William R. Harris, San Antonio, Tex.

[73] Assignee: Hidea Innovative Products, L.C., San Antonio, Tex.

[21] Appl. No.: 785,994

[22] Filed: Jan. 21, 1997

Related U.S. Application Data

[60] Provisional application No. 60/010,388, Jan. 22, 1996.

[51] Int. Cl.[6] ..... A47B 43/00

[52] U.S. Cl. ..... 211/196; 211/203; 248/166; 223/120

[58] Field of Search ..... 211/197, 196, 211/205, 203, 204; 248/166, 167, 171; 223/120

[56] References Cited

U.S. PATENT DOCUMENTS

| | | | |
|---|---|---|---|
| 984,591 | 2/1911 | Nelson . | |
| 1,075,395 | 10/1913 | Beegle . | |
| 1,176,563 | 3/1916 | Johnson . | |
| 1,274,849 | 8/1918 | Bullerdick | 211/196 X |
| 1,525,701 | 2/1925 | Rose et al. . | |
| 2,247,774 | 7/1941 | Forsyth | 211/196 |
| 3,069,021 | 12/1962 | Gray | 211/197 |
| 4,317,553 | 3/1982 | Meinunger | 211/203 X |
| 4,550,840 | 11/1985 | Van Deursen | 211/197 |
| 4,813,552 | 3/1989 | Walter | 211/204 X |

FOREIGN PATENT DOCUMENTS

| | | | |
|---|---|---|---|
| 902188 | 8/1945 | France | 211/197 |

*Primary Examiner*—Peter M. Cuomo
*Assistant Examiner*—Janet M. Wilkens
*Attorney, Agent, or Firm*—Miller, Sisson, Chapman & Nash, P.C.

[57] ABSTRACT

A collapsible and foldable portable valet having upper and lower vertical support members. An upper sleeve is slidable about the upper support member to urge shoulder-lifting arms to extend and support left and right shoulder members and a hanger extension. A lower sleeve is slidable about the lower vertical member to urge legs to extend through a guiding and support brace to stabilize the valet. Channels are provided in the support members to accept the lifting arms and legs to provide a narrow profile and to reduce the space required to store the valet. A second hanger extension is provided to telescopingly extend and collapse within the hollow upper vertical support member. A multiplicity of detent mechanisms lock elements into an extended position. The shoulder members are shaped to provide for full support of a garment hung thereon.

7 Claims, 6 Drawing Sheets

PORTABLE VALET

BACKGROUND OF THE INVENTION

This application claims the benefit of U.S. provisional application Ser. No. 60/010,388, filed Jan. 22, 1996.

This invention relates to a device for hanging clothing, and more particularly, to a collapsible and foldable valet which results in a streamline, narrow, portable configuration.

There are numerous garment supporters or racks in the prior art. Such devices are disclosed in U.S. Pat. Nos. 984,591; 1,075,395; 1,176,563; and 1,525,701. However, nothing in the prior art teaches the structure of the present invention whereby a valet may be collapsed and folded into the present unique, reduced collapsed configuration while at the same time providing improved support for the shoulder members and hanger extensions when in the extended position. The prior art generally does not teach providing additional support beneath any outstretched member; thus, the weight of clothing hung from the racks of the prior art often results in the collapse or deformation of the rack. The clothing hung from the prior art racks often becomes twisted and wrinkled, thereby defeating a principal purpose of such racks.

The present invention solves the problems of the prior art by providing shoulder and hanger lifting arms which support the outstretched members when the valet is in use. Further, the slidable upper and lower sleeves of the present invention facilitate smooth and effortless extension of the unitary, curved shoulders, the hangers, and the extensible legs. The lower sleeve cooperates with an end, leg brace to ensure the proper orientation and alignment of the extensible legs of the present invention. The elimination of the numerous attachment screws and thumb screws of the prior art is a further advantage of the present invention.

SUMMARY OF THE PRESENT INVENTION

The present invention provides a strong, yet collapsible and foldable, portable valet. Upper and lower vertical support members are hingedly connected so as to reduce the overall length of the valet when folded. The vertical support members are provided with elongated channels along the outer length to allow for the supporting and lifting arms and the extensible legs to fully collapse and lie parallel to and against the vertical supports. This reduces the overall width or profile of the collapsed valet. The lifting arms are pivotally attached at one end to an upper sleeve which fits over and slides along the length of the upper vertical member. The other ends of the lifting arms are appropriately attached to the shoulders and hanger extension. When the upper sleeve is moved upwardly from a collapsed position to an extended position, the lifting arms pivot about the sleeve and the shoulders and hanger. The arms provide support beneath the outstretched shoulder members and hanger. An additional hanger extension is provided to telescope out from the top end of the upper vertical support and to rotate to an extended locked position.

The lower vertical support member is provided with a lower sleeve which cooperates with an end, leg brace attached to the lower end of the lower vertical support member to control the collapse and extension of the legs of the valet. As with the upper support member, the lower vertical support member is provided with elongated channels extending along the outer length of the support member to allow the extensible legs to collapse and lie parallel to and against the vertical support, thereby resulting in a narrow, flush profile in the collapsed position.

BRIEF DESCRIPTION OF THE DRAWINGS

The invention will be better understood and objects other than those set forth above will become apparent when consideration is given to the following detailed description of the preferred embodiments. Such description makes reference to the annexed drawings wherein.

DETAILED DESCRIPTION OF THE PREFERRED EMBODIMENT

Figure 1:
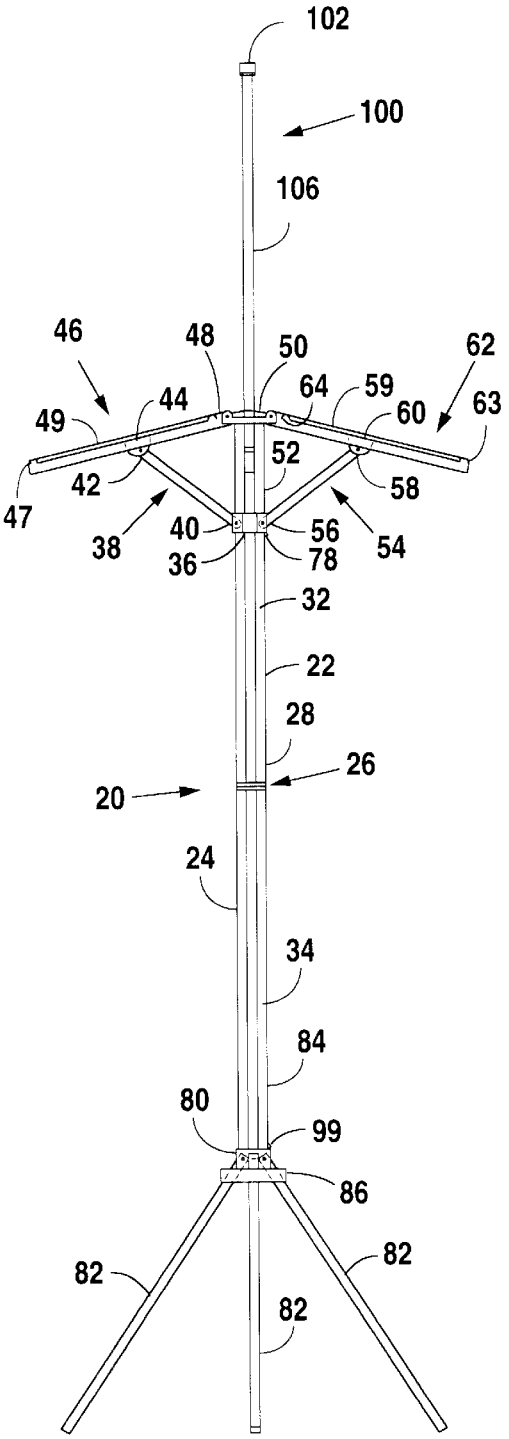
FIG. 1 is a front elevation view of the present invention in the extended and unfolded, open position.
Figure 2:
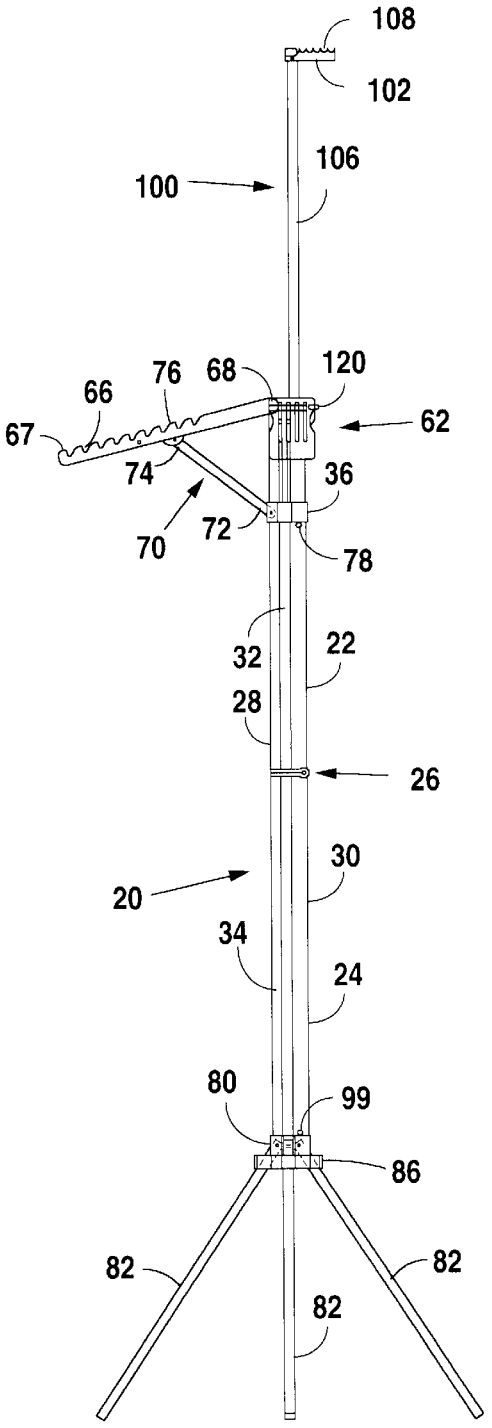
FIG. 2 is a side elevation view of the present invention in the extended and unfolded, open position.

Turning to the figures and more particularly to FIGS. 1 and 2, the valet 20 of the present invention is shown. The valet 20 has an upper vertical support member 22 and a lower vertical support member 24 hingedly connected by hinge 26 attached to first end 30 of lower vertical support member 24. Normally the vertical support members 22 and 24 are hollow tubing sections. Vertical members 22 and 24 may be made of extruded aluminum tubing, plastic tubing or other suitable composition. Elongated channels 32 and 34 extend the entire length of the vertical support members as may be clearly seen in FIGS. 3 and 6.

An upper sleeve 36 is slidingly fitted around the outer circumference of the upper vertical member 22. A detailed illustration of sliding sleeve 36 may be seen in FIG. 6. The sleeve 36 follows the contour of the vertical support member 22 and may be composed of any material which will easily slide up and down the upper vertical support member 22.

First shoulder-lifting arm 38 is pivotally attached at a first end 40 to the upper sleeve 36 and at a second end 42 to beneath the midpoint 44 of right shoulder member 46. The proximal end 48 of shoulder 46 is pivotally attached to a shoulder brace 50 attached to the top or second end 52 of upper vertical support member 22. Shoulder-lifting arm 38 is positioned within a channel 32 and lies parallel to and against the vertical support member 22 when the sleeve 36 is in the collapsed position.

In a like manner, a second shoulder-lifting arm 54 is pivotally attached at a first end 56 to the upper sleeve 36 and at a second end 58 to beneath the midpoint 60 of left shoulder member 62. The proximal end 64 of left shoulder 62 is pivotally attached to shoulder brace 50 opposite the right shoulder member 46. Shoulder-lifting arm 54 is positioned within a channel 32 and lies parallel to and against the vertical support member 22 when the sleeve 36 is in a collapsed position.

In FIG. 2, it may be seen that a first hanger extension 66 having a multiplicity of hanging notches 67 is pivotally connected at a proximal end 68 to the shoulder brace 50 between and generally perpendicular to the right and left shoulder members. A hanger-lifting arm 70 is pivotally attached at a first end 72 to the upper sleeve 36 and at a second end 74 to beneath the approximate midpoint 76 of the hanger extension 66. Hanger-lifting arm 70 is positioned within a channel 32 and lies parallel to and against the vertical support member 22 when the sleeve 36 is in a collapsed position.

Thus, when the sleeve 36 is pushed upward from a first collapsed position (FIG. 4) toward the top or second end 52 of the upper vertical support member 22, the shoulder members 46 and 62 and hanger extension 66 are moved from a collapsed position lying generally parallel to and against vertical support member 22 to an extended position extending generally radially outwards from the vertical support member 22. When the sleeve 36 passes over upper locking dent 78, the sleeve is held and locked in the extended position. Lift arms 38, 54, and 70 provide support to the outstretched shoulder members 46 and 62 and hanger extension 66 so that they may bear the weight of clothing hung over the shoulder members and the hanger extension along hanging notches 67.

The valet 20 further has a lower sleeve 80 slidingly fitted around the outer circumference of the lower vertical support member 24. The lower sleeve 80 is identical to upper sleeve 36 and may be seen in FIG. 6. The sleeve 80 follows the contour of the lower vertical support member 24 and may be composed of any material which will easily slide up and down the lower vertical support member 24.

Figure 6:
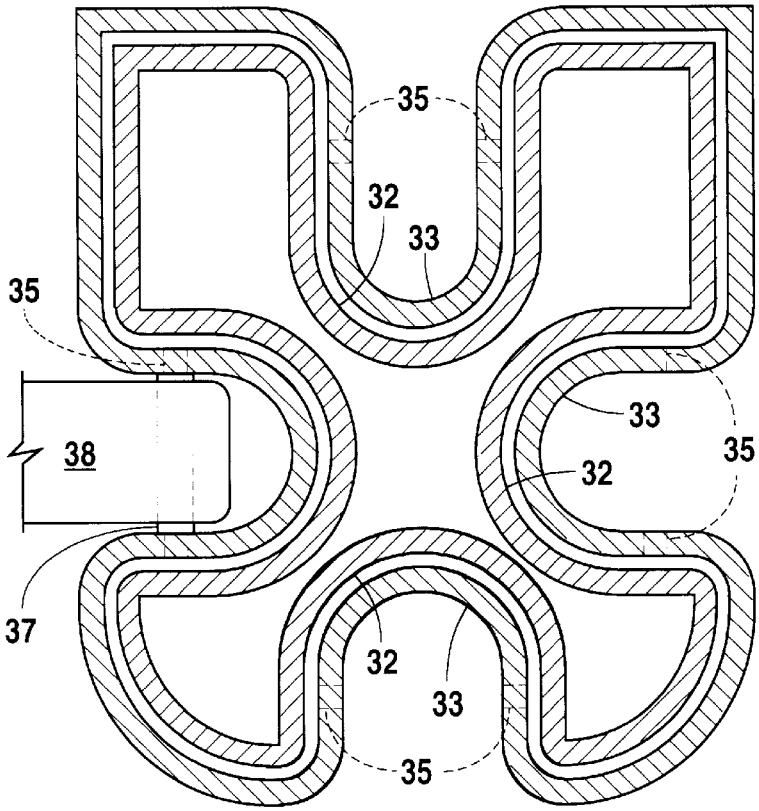
FIG. 6 is a top, cross-sectional view of the upper and lower sleeves of the present invention.

Sleeves 36 and 80 have channels 33 which conform to the channels 32 in the vertical support members 22 and 24 as seen in FIG. 6. Each sidewall of the sleeve channels is provided with an opening 35 for retaining a pivot pin 37 which passes through the lifting arms 38, 54 and 70 to allow the arms to pivot when the sleeve 36 is moved. For clarification, FIG. 6 shows only one pin 37 passing through the first shoulder-lifting arm 38 and into opening 35. As will be further discussed below, lower sleeve 80 will have the same openings 35 for retaining pivot pins 37 which will pass through the legs 82 to allow the legs 82 to pivot when the lower sleeve 80 is slid along lower vertical member 24.

Figure 7:
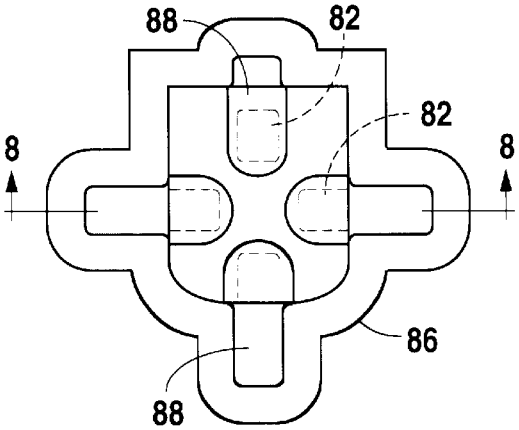
FIG. 7 is a top, plan view of the leg brace of the present invention.
Figure 8:
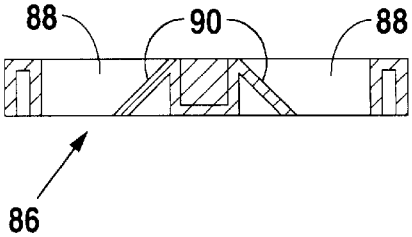
FIG. 8 is a cross-sectional view of the leg brace of the present invention taken along line 8—8 of FIG. 7.

FIGS. 1 and 2 further illustrate the extension of legs 82 from the second end 82 of the lower vertical support member 24. A leg brace 86 is affixed to the second end 84 and cooperates with the lower sleeve 80 to align and support the extended legs 82. FIGS. 7 and 8 are detailed illustrations of the leg brace 86. Brace 86 has four leg support openings 88 through which legs 82 pass and are supported. Inner slanting walls 90 provide a surface on which the inner side of the legs 82 may be supported and the angle of the slant ensures that each leg is oriented or aligned to reduce wobble and to stabilize the valet when fully extended for use.

A lower locking detent 99 extends through the lower vertical support member 24 above and spaced apart from the leg brace 86. When the lower sleeve 80 is slid downwardly towards the second end 84 of the lower vertical support 24, legs 82 pivotally attached to the sleeve 80 move downwardly and radially outwardly through leg brace opening 88. The slanted side walls 90 urge the legs 82 into the proper angular orientation as they are extended. When the sleeve 80 passes over the lower locking detent 99, the detent mechanism (well known in the art) retains the sleeve 80 against the leg brace 86 and locks the legs 82 in place.

Figure 3:
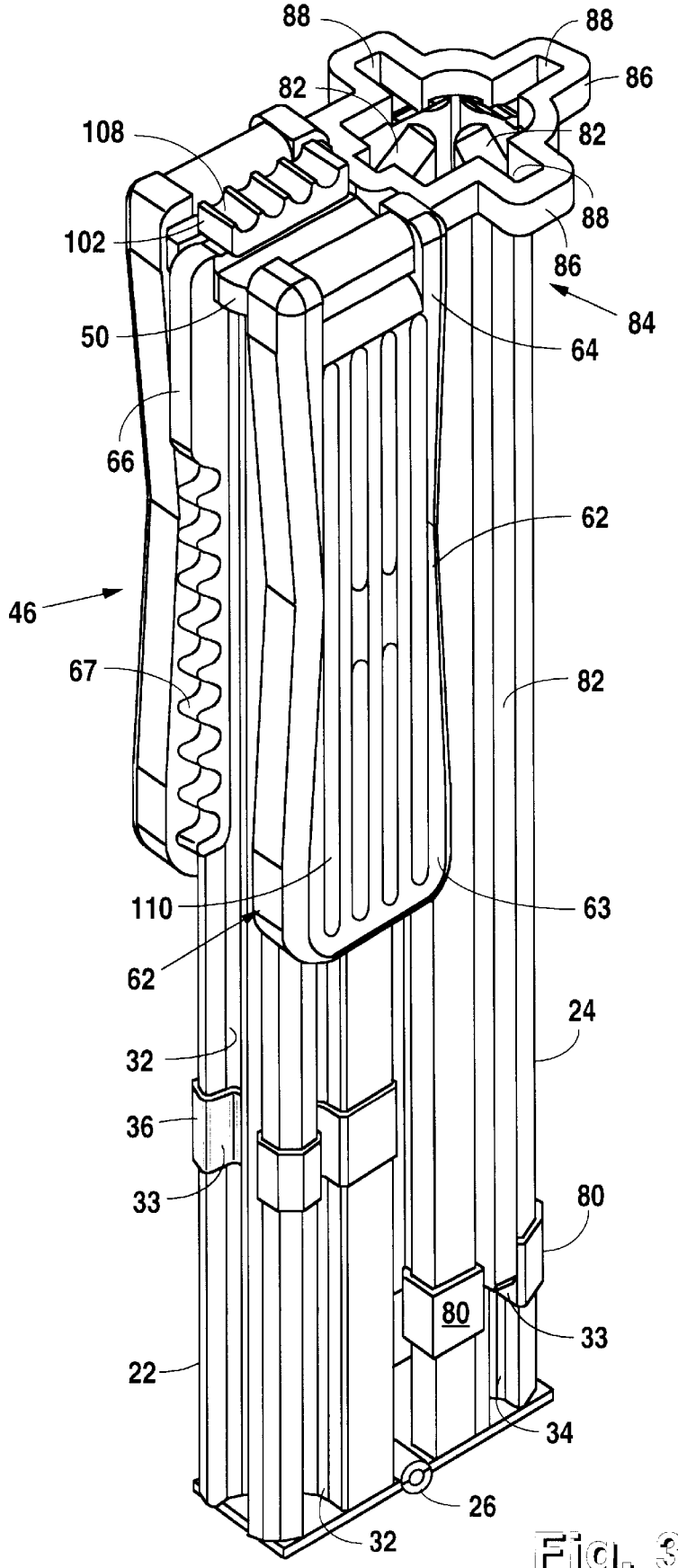
FIG. 3 is a front, left side perspective view of the present invention in the collapsed and folded positions.

FIG. 3 further illustrates brace 86 with leg support opening 88 through which legs 82 are guided and supported. Brace 86 is attached to the second end 84 of lower vertical support member 24.

Figure 4:
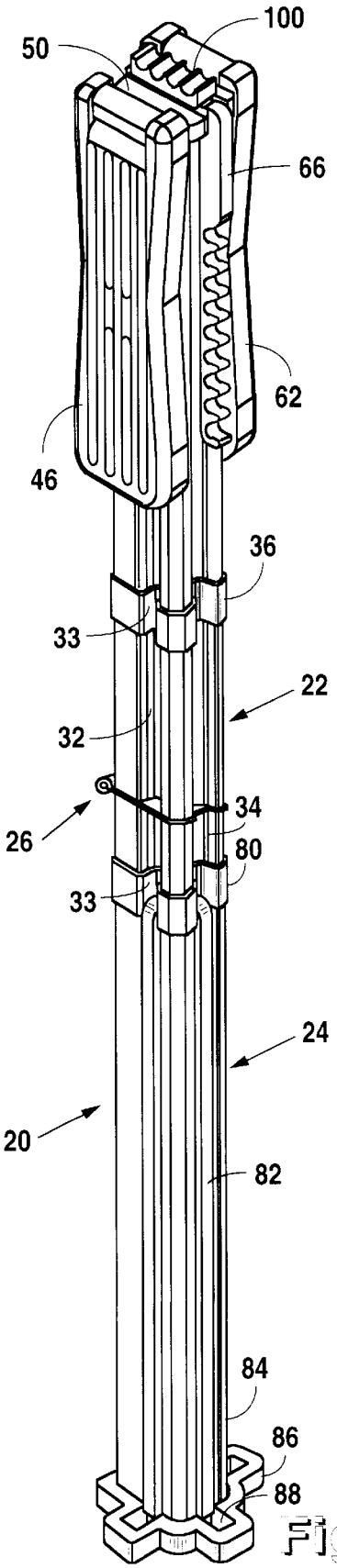
FIG. 4 is a front, right side perspective view of the present invention in the collapsed and unfolded positions.

FIG. 4 illustrates the valet 20 of the present invention in the collapsed but unfolded position. Sleeves 36 and 80 are in the collapsed position. The legs 82 are not extended. The shoulder members 46 and 62 and first hanger extension 66 are not extended. Second hanger extension 100 is in the retracted or collapsed position.

Figure 5:
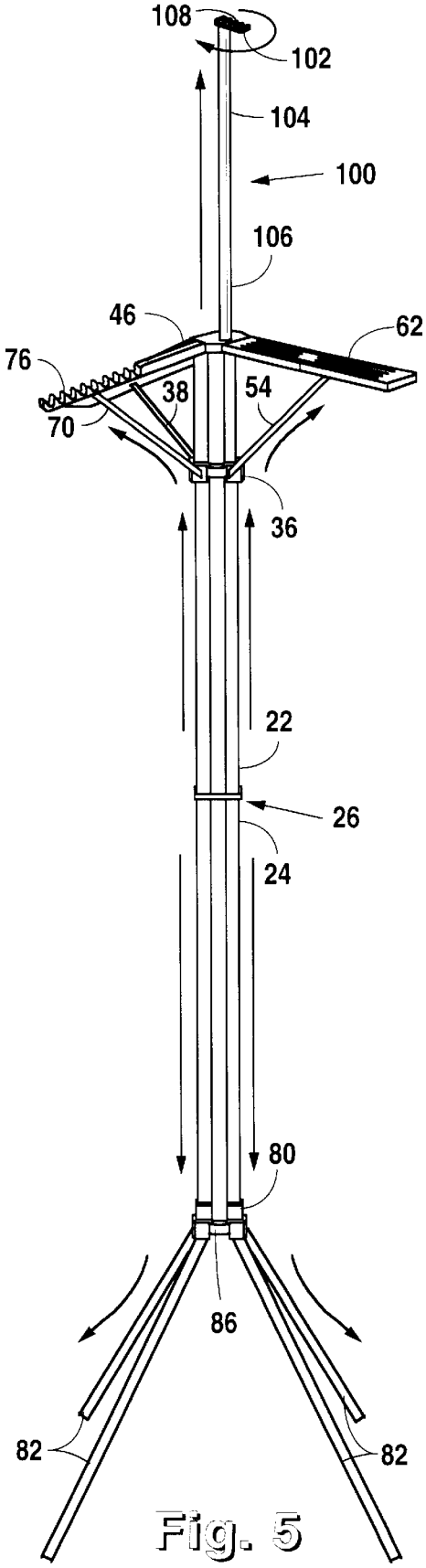
FIG. 5 is a front, left side perspective view of the present invention in the extended and unfolded positions.

FIG. 5 is a perspective view illustrating the extension of the outstretched members of the valet 20. In FIG. 5 it may have seen that upper sleeve 36 has been slid upwardly in the direction of the arrow along upper vertical support member 22 extending left arms 38, 54, and 70 which support shoulders 46 and 62 and hanger extension 76. Lower sleeve 80 has been slid downwardly in the direction of the arrows along lower vertical support member 24 extending legs 82 through brace 86.

A second hanger extension 100 is shown in FIG. 5 telescopingly withdrawn from the inside of the second end 52 of the hollow upper vertical support member 22. An extension head 102 is attached to an upper end 104 of a vertical neck 106. The second extension 100 is rotated 180° to face the back of the valet 20 to provide additional hanging area for clothing. Head 102 is provided with a multiplicity of hanging notches 108.

A lock pin or detent 120 (FIG. 2) cooperates with the vertical neck 106 and the upper vertical member 22 to retain the second hanger extension 100 in the rotated, locked position. Pin 120 may be any type which will hold the extension 100 in the upstanding position.

Figure 9:
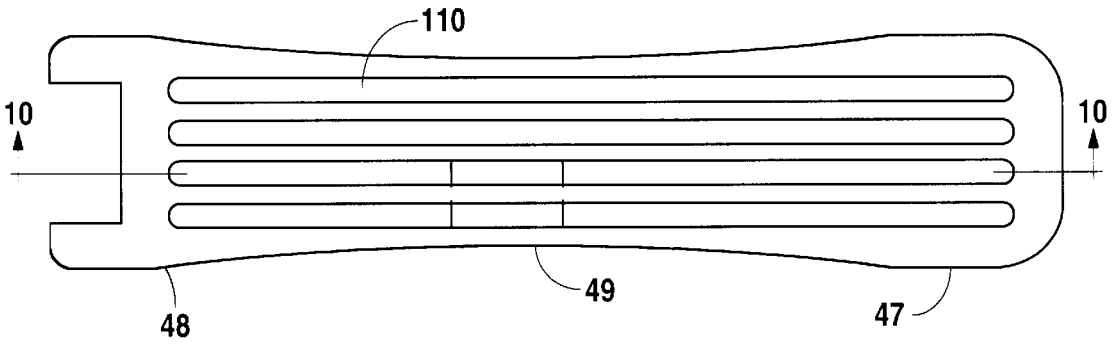
FIG. 9 is a top view of the shoulder member of the present invention.
Figure 10:
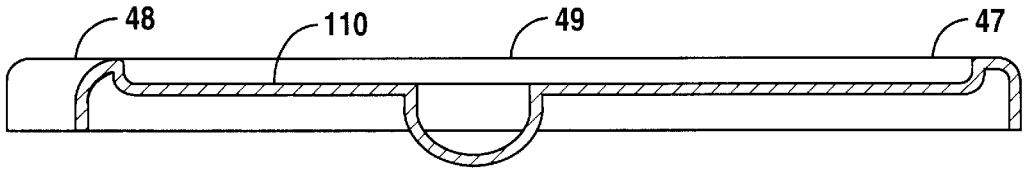
FIG. 10 is a cross-sectional view of the shoulder member of the present invention taken along line 10—10 of FIG. 9.

Turning to FIGS. 9 and 10, shoulder member 46 is shown in detail. Shoulder member 62 is identical to member 46 shown in FIG. 9. Each shoulder member has a proximal end 48 (or 64 for member 62), a distal end 47 (or 63 for member 62), and a midsection 49 (or 59 for member 62). The proximal and distal ends are flared to a wider width than the midsection to provide for an improved hanging and support surface for garments hung on the valet 20. Shoulder member 46 is further provided with grooves 110 to hold accessory items such as jewelry, shirt, stays and the like.

Figure 11:
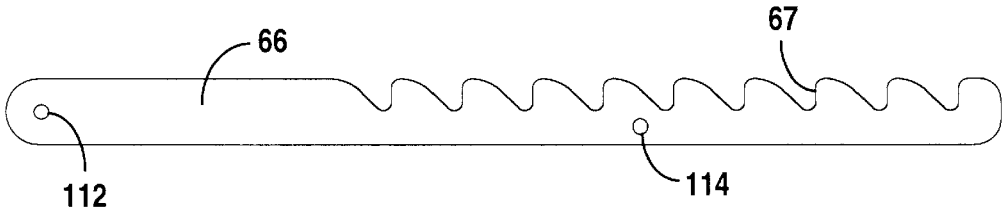
FIG. 11 is a side elevation view of a hanger extension of the present invention.

FIG. 11 illustrates a side elevation view of the first hanger extension 66 with hanging notches 67. Openings 112 and 114 are provided for attachment to the shoulder brace 58 and the lifting arm 70.

Figure 12:
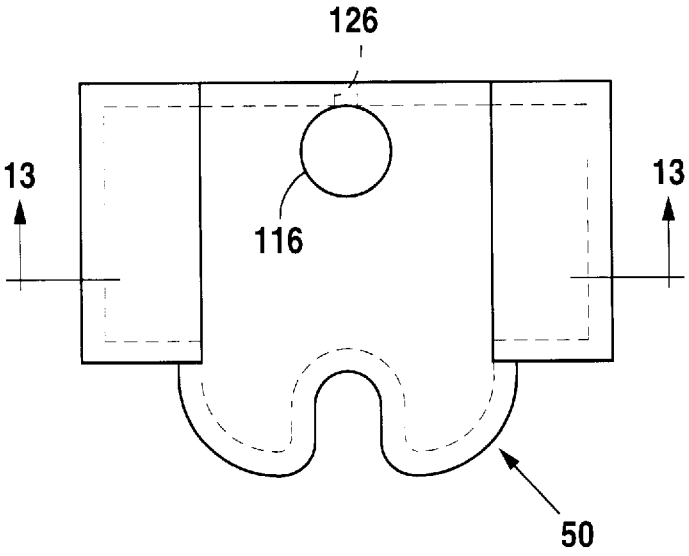
FIG. 12 is a top plan view of the shoulder brace of the present invention.
Figure 13:
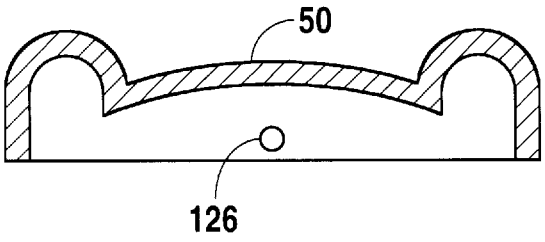
FIG. 13 is a cross-sectional view of the shoulder brace of the present invention taken along line 13—13 of FIG. 12.

FIGS. 12 and 13 show the details of the shoulder brace 50 of the present invention. An opening 116 is provided for the telescoping neck 106 of the second hanger extension 100. Opening 126 accepts detent 120 (FIG. 2) to retain extension 100 (FIG. 2) in the upstanding postion, as described above.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. A valet comprising:

upper and lower vertical support members each having a first end and a second end, said vertical support members hingedly connected to each other at said first ends; said upper vertical support member and said lower vertical support member movable about a hinge from a folded position to an unfolded position;

an upper sleeve, slidably affixed about said upper support member;

first and second shoulder-lifting arms, each having a first end and a second end, said arms pivotally attached at said first end to said upper sleeve;

a right shoulder member attached at generally a midpoint of said right shoulder member to said second end of said first shoulder-lifting arm and pivotally attached at a first proximal end to a shoulder brace attached to said second end of said upper vertical support member;

a left shoulder member attached at generally a midpoint of said left shoulder member to said second end of said second shoulder-lifting arm and pivotally attached at a second proximal end to said shoulder brace opposite said right shoulder member;

a hanger extension pivotally attached at a third proximal end to said shoulder brace between said right and said left shoulder members;

a hanger-lifting arm pivotally attached at a first end to said upper sleeve and pivotally attached at a second end to an approximate midpoint of said hanger extension;

said upper sleeve slidable from a first collapsed position wherein said right and left shoulder members, said hanger extension, said first and second shoulder-lifting arms, and said hanger-lifting arm all lie generally parallel to and against said upper vertical support member to a first extended position wherein said right and left shoulder members and said hanger extension extend radially outward from said upper vertical support member;

a lower sleeve slidably affixed about said lower vertical support member;

a plurality of extensible legs each having a first end and a second end, each of said legs pivotally attached at said first end to said lower sleeve;

a leg brace attached to said second end of said lower vertical support member, said leg brace having a plurality of leg support openings;

said lower sleeve slidable from a second collapsed position wherein all of said legs lie generally parallel to and against said lower vertical support member to a second extended position wherein said legs pass through and are supported by said leg brace and extend radially outward from said lower vertical support member, said upper vertical support member having channels extending along an outer length of said upper vertical support member, said first and second shoulder-lifting arms and said hanger-lifting arm attached to said upper sleeve so as to be positioned within said channels when said upper sleeve is in said first collapsed position.

2. The valet of claim 1 wherein said lower vertical support member has channels extending along an outer length of said lower vertical support member, said legs attached to said lower vertical support so as to be positioned within said channels when said lower sleeve is in said second collapsed position.

3. The valet of claim 1 further comprising:

a second hanger extension having a vertical neck portion telescopingly extensible from an inside of said second end of said upper vertical support member; and a hanger head attached at an upper end of said neck portion and rotatable from a third collapsed position to a third extended and locked position.

4. The valet of claim 3 further comprising a lock pin cooperating with said neck portion of said second hanger extension and said upper vertical support member to secure said second hanger extension in said third extended and locked position.

5. The valet of claim 1 wherein said right shoulder member and said left shoulder member each further comprise a flared distal end having a width substantially equal to said proximal end; and a midsection contiguous with said flared distal end, said midsection having a width less than that of said distal and proximal ends.

6. A valet comprising:

upper and lower vertical support members each having a first end and a second end, said vertical support members hingedly connected to each other at said first ends; said upper vertical support member and said lower vertical support member movable about a hinge from a folded position to an unfolded position;

an upper sleeve, slidably affixed to said upper support member;

first and second shoulder-lifting arms attached to said upper sleeve;

a right shoulder member attached to said first shoulder-lifting arm and pivotally attached to said upper vertical support member;

a left shoulder member attached to said second shoulder-lifting arm and pivotally attached to said upper vertical support member opposite said right shoulder member;

a hanger extension pivotally attached to said upper vertical member between said right and said left shoulder members;

a hanger-lifting arm pivotally attached to said upper vertical member and pivotally attached to said hanger extension;

said upper sleeve slidable from a first collapsed position wherein said right and left shoulder members, said hanger extension, said first and second shoulder-lifting arms, and said hanger-lifting arm all lie generally parallel to and against said upper vertical support member to a first extended position wherein said right and left shoulder members and said hanger extension extend radially outward from said upper vertical support member;

a plurality of extensible legs each having a first end and a second end;

said legs movable from a second collapsed position wherein all of said legs lie generally parallel to and against said lower vertical support member to a second extended position wherein said legs extend radially outward from said lower vertical support member;

wherein said upper vertical support member has channels extending along an outer length of said upper vertical support member, said first and second shoulder-lifting arms and said hanger-lifting arm attached to said upper vertical support member so as to be positioned within said channels when said upper sleeve is in said first collapsed position.

7. A valet comprising:

upper and lower vertical support members each having a first end and a second end, said vertical support members hingedly connected to each other at said first ends; said upper vertical support member and said lower vertical support member movable about a hinge from a folded position to an unfolded position;

an upper sleeve, slidably affixed to said upper support member;

first and second shoulder-lifting arms attached to said upper sleeve;

a right shoulder member attached to said first shoulder-lifting arm and pivotally attached to said upper vertical support member;

a left shoulder member attached to said second shoulder-lifting arm and pivotally attached to said upper vertical support member opposite said right shoulder member;

a hanger extension pivotally attached to said upper vertical member between said right and said left shoulder members;

a hanger-lifting arm pivotally attached to said upper vertical member and pivotally attached to said hanger extension;

said upper sleeve slidable from a first collapsed position wherein said right and left shoulder members, said hanger extension, said first and second shoulder-lifting arms, and said hanger-lifting arm all lie generally parallel to and against said upper vertical support member to a first extended position wherein said right and left shoulder members and said hanger extension extend radially outward from said upper vertical support member;

a plurality of extensible legs each having a first end and a second end;

said legs movable from a second collapsed position wherein all of said legs lie generally parallel to and against said lower vertical support member to a second extended position wherein said legs extend radially outward from said lower vertical support member;

a second hanger extension having a vertical neck portion telescopingly extensible from an inside of said second end of said upper vertical support member; and a hanger head attached at an upper end of said neck portion and rotatable from a third collapsed position to a third extended and locked position.

* * * * *